US009782883B2

(12) United States Patent
Fuchs et al.

(10) Patent No.: US 9,782,883 B2
(45) Date of Patent: Oct. 10, 2017

(54) PORTABLE MACHINE TOOL

(71) Applicant: Robert Bosch GmbH, Stuttgart (DE)

(72) Inventors: Rudolf Fuchs, Neuhausen (DE); Florian Bantle, Gruibingen (DE)

(73) Assignee: Robert Bosch GmbH, Stuttgart (DE)

( * ) Notice: Subject to any disclaimer, the term of this patent is extended or adjusted under 35 U.S.C. 154(b) by 740 days.

(21) Appl. No.: 14/076,347

(22) Filed: Nov. 11, 2013

(65) Prior Publication Data

US 2014/0144664 A1 May 29, 2014

(30) Foreign Application Priority Data

Nov. 28, 2012 (DE) ..... 10 2012 221 758

(51) Int. Cl.
*B25F 5/00* (2006.01)
*B25F 5/02* (2006.01)

(52) U.S. Cl.
CPC ..... *B25F 5/00* (2013.01); *B25F 5/001* (2013.01); *B25F 5/008* (2013.01); *B25F 5/02* (2013.01)

(58) Field of Classification Search
USPC ..... 173/216
See application file for complete search history.

(56) References Cited

U.S. PATENT DOCUMENTS

| | | | | |
|---|---|---|---|---|
| 5,533,581 | A * | 7/1996 | Barth | B23Q 5/045 173/216 |
| 6,244,358 | B1 * | 6/2001 | Beer | B25B 21/00 173/170 |
| 6,315,060 | B1 * | 11/2001 | Schuda | B23Q 5/027 173/115 |
| 2012/0145427 | A1 | 6/2012 | Fuchs | |
| 2012/0152580 | A1 * | 6/2012 | Mattson | B25B 21/00 173/94 |
| 2013/0000936 | A1 * | 1/2013 | Onoda | B25D 16/00 173/117 |

FOREIGN PATENT DOCUMENTS

| | | | |
|---|---|---|---|
| CN | 2691797 | Y | 4/2005 |
| CN | 101224571 | A | 7/2008 |
| CN | 102554886 | A | 7/2012 |
| DE | 201 11 644 | U1 | 11/2001 |
| EP | 0 561 233 | A1 | 9/1993 |

* cited by examiner

*Primary Examiner* — Michelle Lopez
*Assistant Examiner* — Chinyere Rushing-Tucker
(74) *Attorney, Agent, or Firm* — Maginot, Moore & Beck LLP

(57) ABSTRACT

A portable machine tool has at least one drive motor, at least one gearbox unit, at least one connecting drive train unit, and at least one actuating element. The at least one connecting drive train unit is configured to transmit a force from the at least one drive motor to the at least one gearbox unit. The at least one connecting drive train unit is also configured to bypass the at least one actuating element.

14 Claims, 6 Drawing Sheets

PORTABLE MACHINE TOOL

This application claims priority under 35 U.S.C. §119 to patent application no. DE 10 2012 221 758.4, filed on Nov. 28, 2012 in Germany, the disclosure of which is incorporated herein by reference in its entirety.

BACKGROUND

Commercially available cordless machine tools in pistol form have an upper housing part on which a tool holder unit is disposed. Behind the tool holder unit are disposed a gearbox unit for a drive mechanism of a tool and a drive motor for a drive mechanism of the gearbox unit.

SUMMARY

A portable machine tool, in particular a cordless machine tool, having at least one drive motor, at least one gearbox unit, at least one connecting drive train unit for a force transmission from the drive motor to the gearbox unit, and at least one actuating element, wherein the connecting drive train unit bypasses the actuating element, is proposed.

By a "portable machine tool" should be understood, in particular, a machine tool which can be guided with one or with two hands of an operator and, in particular, is different from a fixedly mounted machine tool. By a cordless machine tool should be understood, in particular, a portable machine tool which is supplied with current by means of an accumulator and/or a battery and which is preferably guided with one hand, wherein, for stabilization of the cordless machine tool during use, a two-handed guidance can be provided. For example, the cordless machine tool can be configured as a cordless drill, a cordless hammer drill, a cordless percussion drill, a cordless impact wrench or, preferably, as a cordless screwdriver. Preferably, the portable machine tool is configured in a pistol form. By a "pistol form" should be understood, in particular, a form of the portable machine tool comprising a handle, in which the portable machine tool can be guided with one hand by the handle and in which operation of the actuating element can be carried out with fingers of a hand gripping the handle, without surrendering a grip for guidance of the portable machine tool. By an "actuating element" should be understood, in particular, an element by means of which a function setting of a portable machine tool, in particular of a cordless machine tool, can be made, in particular a switching on or off or a setting of power values of the cordless machine tool. Preferably, the actuating element is configured as a pressure switch, and particularly preferably, as a trigger switch. In principle, the actuating element can also be otherwise configured, for example as a rotary switch or as a touch display. In a configuration of the portable machine tool in pistol form, the actuating element is preferably disposed on the upper housing part or on the handle directly adjacent to the upper housing part. By a "trigger switch" should be understood, in particular, a switch configured in the form of a gun trigger, which switch is actuated with at least one finger and, after a certain pressure threshold is exceeded, a pressure on the trigger switch effects a function setting, wherein, after the pressure threshold is exceeded, the function setting can be configured such that it is variable in line with changes in pressure. In particular, the drive motor is configured to drive a tool mounted in the tool holder unit. Preferably, the drive is formed by an electric motor, and particularly preferably, by a brushless direct-current motor (BLDC motor), which is supplied with current in particular by an accumulator of a cordless machine tool.

By a "connecting drive train unit" should be understood, in particular, a unit having at least one substantially rod-shaped connecting drive train, preferably rotatably mounted, for force transmission, which connecting drive train unit at one end is connected to the drive motor and is driven by the latter and at a further end is connected to the tool holder unit and transmits thereto a force of the drive motor. In the force flux direction from the drive motor to the tool holder unit, in front of or behind the connecting drive train can be arranged a gearbox unit, this being preferably disposed between the connecting drive train and the tool holder unit. The connecting drive train unit transmits, in particular, forces from the drive motor to the gearbox unit in order to drive the tool holder unit and/or to drive an insert tool accommodated in the tool holder unit. By "bypasses" should be understood, in particular, that, particularly due to a position of the at least one actuating element on the portable machine tool, a path of the force transmission from the drive motor to the tool holder unit turns out to be longer than a path of the force transmission given a hypothetical course of the connecting drive train unit through the position of the actuating element on the portable machine tool, wherein the connecting drive train, given the hypothetical course of the connecting drive train unit through the position of the actuating element on the portable machine tool, runs, in particular, fully within the housing of the portable machine tool, apart from a passage through a possible actuating finger enclosure. Preferably, the connecting drive train unit is arranged at least partially separated from the actuating element by a housing of the portable machine tool. In particular, viewed in a machining direction, the drive motor is disposed at least partially in front of the actuating element, the gearbox unit is disposed at least partially after the actuating element, and preferably the actuating element is disposed fully in a region between the drive motor and the actuating element. Preferably, the connecting drive train unit runs at least substantially parallel to the center axis of the tool holder unit and parallel to a longitudinal extent of an actuating finger enclosure, in which the actuating element is disposed. Preferably, the gearbox unit and the drive motor are arranged such that a shortest connecting line, disposed within the portable machine tool, between the gearbox unit and the drive motor deviates from a straight line. In particular, a compact portable machine tool and a highly flexible arrangement of the actuating element can be achieved.

In addition, a pistol grip is proposed. By "a pistol grip" should be understood, in particular, a handle protruding at least substantially perpendicularly from an upper housing part, comprising the tool holder unit, for a one-handed guidance of the portable machine tool, wherein a user, with one or more fingers of one hand with which he clasps the pistol grip for the guidance of the portable machine tool, can actuate an actuating element of the cordless machine tool without surrendering a grip around the pistol grip. By "at least substantially perpendicularly" should be understood, in particular, that an angle between the pistol grip and the upper housing part deviates maximally by twenty, advantageously maximally by ten, and preferably maximally by one degree from 90 degrees. In particular, the pistol grip can protrude from the upper housing part at an angle of 90 degrees. In particular, advantageous grip ergonomics can be achieved.

It is further proposed that the connecting drive train unit runs at least substantially above the actuating element. By the connecting drive train unit "runs at least substantially above the actuating element" should be understood, in particular, that the connecting drive train unit is disposed on a side of the actuating element which is facing toward the top side of the portable machine tool and is facing away from the handle, and that at least sixty, advantageously at least eighty, and preferably one hundred percent of a longitudinal extent of the connecting drive train unit is disposed in a region above a projection of the actuating element in a direction perpendicular to a height direction of the actuating element. In principle, the connecting drive train unit can also bypass the actuating element beneath it, to the left of it or to the right of it. In particular, a compact portable machine tool can be achieved.

In addition, a tool holder unit having a center axis running at least through a surrounding area of the actuating element is proposed. By a "tool holder unit" should be understood, in particular, a unit of the portable machine unit which is configured to receive and fasten an insert tool, for example a bit of a screwdriver or a drill bit. In particular, the tool holder unit has for this purpose an advantageously at least substantially cylindrical receiving region for the tool. The tool holder unit is disposed, in particular, on an upper housing of a cordless machine tool. By a "center axis of the tool holder unit" should be understood, in particular, an infinitely extended straight line running through the middle of the receiving region for the tool in a direction of orientation of a received tool. In particular, the center axis of the tool holder unit corresponds to a force action line of the portable machine tool. By a "surrounding area" should be understood, in particular, an area around the actuating element which is bounded by a distance of maximally 5 mm from the actuating element. As a result of the disclosed configuration of the portable machine tool, in particular an improved guidance of a portable machine tool and improved grip ergonomics can be achieved.

It is further proposed that the center axis of the tool holder unit runs through the actuating element. In particular, an improved guidance of a portable machine tool and improved grip ergonomics can be achieved.

In addition, an actuating finger enclosure, within which an actuating element is disposed, is proposed. By an "actuating finger enclosure" should be understood, in particular, a space bounded by at least three sides of a housing of a cordless machine tool, which space is configured to receive at least one finger of an operator of the cordless machine tool and to provide at least one guide region for the finger during actuation of the actuating element, as well as, preferably, additionally to protect the finger from possible injuries, in particular caused by material fragments which might be flying around during use of the portable machine tool or by slippage of the portable machine tool. In particular, an advantageous guidance and a protection of the finger during actuation of the actuating element can be achieved.

It is further proposed that the actuating finger enclosure is configured closed on at least four sides. Preferably, the actuating finger enclosure is bounded and closed on one side by a connecting web. In particular, the side bounded by the connecting web is formed by a side of the actuating finger enclosure which is situated in a ventral direction. By a "ventral direction" should be understood, in particular, a direction running perpendicular to the center axis of the tool holder unit and along which the handle substantially extends. In particular, an advantageous guidance of the finger upon contact against the actuating element can be achieved.

It is further proposed that the actuating finger enclosure has a height extent of at least 2 cm. By a "height extent" should be understood, in particular, an extent of the actuating finger enclosure in a direction which runs perpendicular to an actuating direction of the actuating element and in which, upon contact of a finger against the actuating element, a finger width extends. In particular, the actuating finger enclosure has a height extent which allows the actuating element to be actuated with two fingers. In particular, a secure guidance of a portable machine tool and a secure actuation of the actuating element can be achieved.

In addition, a handle, within which the drive motor is at least substantially disposed, is proposed. By "at least substantially disposed within the handle" should be understood, in particular, that the drive motor lies at least with seventy, advantageously at least with ninety, and particularly preferably with one hundred percent of its volume within the handle. Preferably, the handle is formed by a pistol grip. As a result of the arrangement of the drive motor in the handle, an improved guidance of a portable machine tool and improved grip ergonomics can be achieved.

It is further proposed that the drive motor is disposed at least partially in a region which, viewed from the tool holder unit, is situated behind the actuating element. In particular, the drive motor is configured to drive a tool mounted in the tool holder unit. Preferably, the drive motor is formed by an electric motor, and particularly preferably by a brushless direct-current motor (BLDC motor), which is supplied with current, in particular, by an accumulator of a cordless machine tool. By the drive motor "is disposed at least partially in a region which, viewed from the tool holder unit, is situated behind the actuating element" should be understood, in particular, that the drive motor is disposed at least partially in a region of the portable machine tool which lies on a projection of the actuating element that runs parallel to the center axis and extends in a direction facing away from the tool holder unit. In particular, an improved guidance of a portable machine tool and improved grip ergonomics can be achieved.

In addition, at least one angle gear unit, which connects the connecting drive train unit to the drive motor, is proposed. By an "angle gear unit" should be understood, in particular, a gearbox which changes a rotary motion at least in one direction. In particular, the angle gear unit is configured to connect a drive motor disposed in the handle, which drive motor is oriented at least substantially in a direction perpendicular to the center axis of the tool holder unit, to a connecting drive train unit running at least substantially parallel to the center axis and to transmit a rotary motion of the output shaft of the drive motor to the connecting drive train unit. In particular, an advantageously space-saving and ergonomic positioning of the drive motor can be achieved with simple configuration.

The disclosed portable machine tool should not be confined to the application and embodiment described above. In particular, the disclosed portable machine tool, in order to fulfill a working method described herein, can have a number of individual elements, parts and units which differs from a number stated herein.

BRIEF DESCRIPTION OF THE DRAWINGS

Further advantages emerge from the following drawing description. In the drawing, six illustrative embodiments of the disclosure are represented. The drawing, the description and the claims contain numerous features in combination. The person skilled in the art will expediently consider the features also individually and combine them into sensible further combinations.

DETAILED DESCRIPTION

Figure 1:
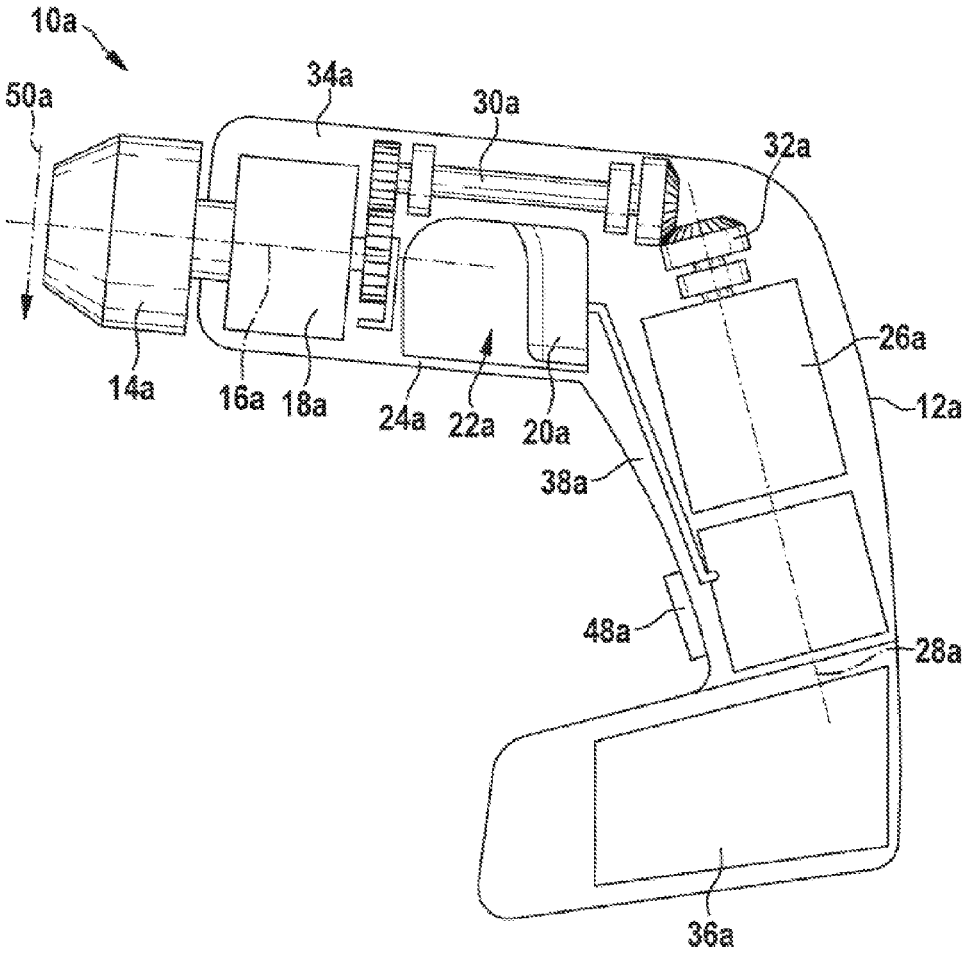
FIG. 1 shows a disclosed portable machine tool, configured as a cordless machine tool, in a pistol form.

FIG. 1 shows a disclosed portable machine tool, which is configured as a cordless machine tool 10*a*. The cordless machine tool 10*a* is configured as a cordless screwdriver. The cordless machine tool 10*a* is configured in a pistol form and has a handle 38*a* by which the cordless machine 10*a* is gripped for usage and guidance. The cordless machine tool 10*a* is configured for one-handed guidance by gripping of the handle 38*a*, wherein, in principle, a second hand of a user can be used to guide the cordless machine tool 10*a*, for example to grip an upper housing part 34*a*. The handle 38*a* is realized as a pistol grip 12*a*. In the shown example, the cordless machine tool 10*a* comprises an actuating element 20*a* and a tool holder unit 14*a*, which latter is configured to receive a screw for screw-in purposes. In the handle 38*a*, a power supply unit 36*a* formed by an accumulator is disposed in a lower region, which, in normal operation, is facing toward a floor and facing away from the upper housing part 34*a*. In alternative embodiments, instead of a power supply unit 36*a* configured as an accumulator, for example, a power supply unit 36*a* configured as a battery can be used. The lower region, in which the power supply unit 36*a* is disposed, is configured so as to project forward, viewed in a direction toward the tool holder. Above the projecting, lower region, a further actuating element 48*a*, which cooperates with the actuating element 20*a* in order to switch on and/or adjust the cordless machine tool 10*a*, is disposed on the handle 38*a*. In alternative embodiments, the further actuating element 48*a* can be dispensed with.

A center axis 16*a* of the tool holder unit 14*a* runs through the actuating element 20*a* and thus through a surrounding area of the actuating element 20*a*. In alternative embodiments of the cordless machine tool 10*a*, the center axis 16*a* of the tool holder unit 14*a* can also run, for example, at a distance of 5 mm above an upper end of the actuating element 20*a* or at a lesser distance therefrom. The center axis 16*a* of the tool holder unit 14*a* has a distance from a center point of the actuating element 20*a*, and two-thirds of a longitudinal extent of the actuating element 20*a* extend on a side of the center axis 16*a* which is facing toward the handle 38*a* and which in normal operation is facing toward the floor. The actuating element 20*a* thus extends for the most part on a side of the center axis 16*a* which is facing toward the handle 38*a* and which, in normal operation, is facing toward the floor. Due to such a course of the center axis 16*a*, advantageous ergonomics can be achieved in respect of actuation of the actuating element 20*a* and guidance of the cordless machine tool 10*a*, since a force action line of the cordless machine tool 10*a*, which runs along the center axis 16*a* of the tool holder unit 14*a*, runs through a hand of a user and beneath at least one actuating finger of the user, whereby unwanted torques on the hand can be avoided.

The cordless machine tool 10*a* has an actuating finger enclosure 22*a*, in which the actuating element 20*a* is disposed. The center axis 16*a* of the tool holder unit 14*a* thus also runs through the actuating finger enclosure 22*a*. The actuating finger enclosure 22*a* is configured closed on a side running parallel to the center axis 16*a* and facing toward the handle 38*a* and is closed there by a connecting web 24*a* between two sections of the upper housing part 34*a*. The connecting web 24*a* is disposed on a side of the center axis 16*a* of the tool holder unit 14*a* which, in a normal operating state, is facing toward the floor, and offers a bearing surface for an actuating finger of the user, as well as protection from any sharp edges or splinters in an environment. The actuating finger enclosure 22*a* has a height extent of 5 cm, whereby an actuation of the actuating element 20*a* by means of two fingers is possible. The height extent is formed by an extent of the actuating finger enclosure 22*a* which runs perpendicular to a longitudinal extent of the actuating finger enclosure 22*a* and substantially perpendicular to the center axis 16*a* of the tool holder unit 14*a*, which extent, in a normal operating state of the cordless machine tool 10*a*, runs parallel to a surface normal of the floor. In principle, the actuating finger enclosure 22*a* can in alternative embodiments have a lesser height extent, so that the actuating element 20*a* can be actuated merely with one actuating finger.

The cordless machine tool 10*a* comprises a drive motor 26*a*, which is disposed at least partially in a region which, viewed from the tool holder unit 14*a*, is situated behind the actuating element 20*a*. Given a projection of the actuating element 20*a* along a direction leading away from the tool holder unit 14*a* and running parallel to the center axis 16*a*, then roughly one half of the drive motor 26*a* lies within a region intersected by the projection, while a further half extends downward in the direction of the handle 38*a*, facing, in a normal operating state, toward a floor. The drive motor 26*a* is disposed within the handle 38*a*. The center axis 16*a* of the tool holder unit 14*a* runs through the drive motor 26*a* and traverses this in an upper region facing toward a top side of the cordless machine tool 10*a*. The top side of the cordless machine tool 10*a* is arranged opposite the handle 38*a* and facing away from the handle 38*a*. A motor axis 28*a* of the drive motor 26*a* forms an angle of 70 degrees with the center axis 16*a* of the tool holder unit 14*a*.

The cordless machine tool 10*a* further has a connecting drive train unit 30*a* for force transmission from the drive motor 26*a* to the tool holder unit 14*a*, which connecting drive train unit runs at least substantially alongside the actuating finger enclosure 22*a*. The connecting drive train unit 30*a* has a rotatably mounted connecting drive train, which at one end is connected to a gearbox and at a further end has a revolving disk with beveled surface, which meshes with an analogously configured revolving disk with beveled surface of an output shaft of the drive motor 26*a*. The revolving disks form an angle gear unit 32*a* of the cordless machine tool 10*a*, which angle gear unit connects the connecting drive train unit 30*a* to the drive motor 26*a*. A gearbox unit 18*a* connects the connecting drive train unit 30*a* to the tool holder unit 14*a* and is configured to match a rotation speed of the output shaft of the drive motor 26*a* to an intended rotation speed of the tool holder unit 14*a* by means of a constant and/or a variable transmission ratio. The gearbox unit 18*a* can be configured, for example, as a planetary gear, wherein the connecting drive train unit 30*a* drive, for example, a sun wheel or planet wheel, a hollow wheel or a planet carrier. The cordless machine tool 10*a* can in alternative embodiments be configured, for example, as a cordless impact wrench or as a cordless percussion drill, and the gearbox unit 18*a* for this comprise, for example, instead of or additionally to a screwdriver gearbox, a gearbox having an impact wrench mechanism, a gearbox having a notched disk for percussion drilling, or a gearbox having a hammer mechanism.

In FIGS. 2 to 6, five further illustrative embodiments of the disclosure are shown. The following descriptions and the drawings substantially confine themselves to the differences between the illustrative embodiments, wherein, with respect to identically labeled parts, in particular with regard to parts having the same reference symbols, reference is fundamentally also made to the drawings and/or the description of the other illustrative embodiments, in particular of FIG. 1. In order to differentiate between the illustrative embodiments, the letter a is placed after the reference symbols of the illustrative embodiment in FIG. 1. In the illustrative embodiments of FIGS. 2 to 6, the letter a is replaced by the letters b to f.

Figure 2:
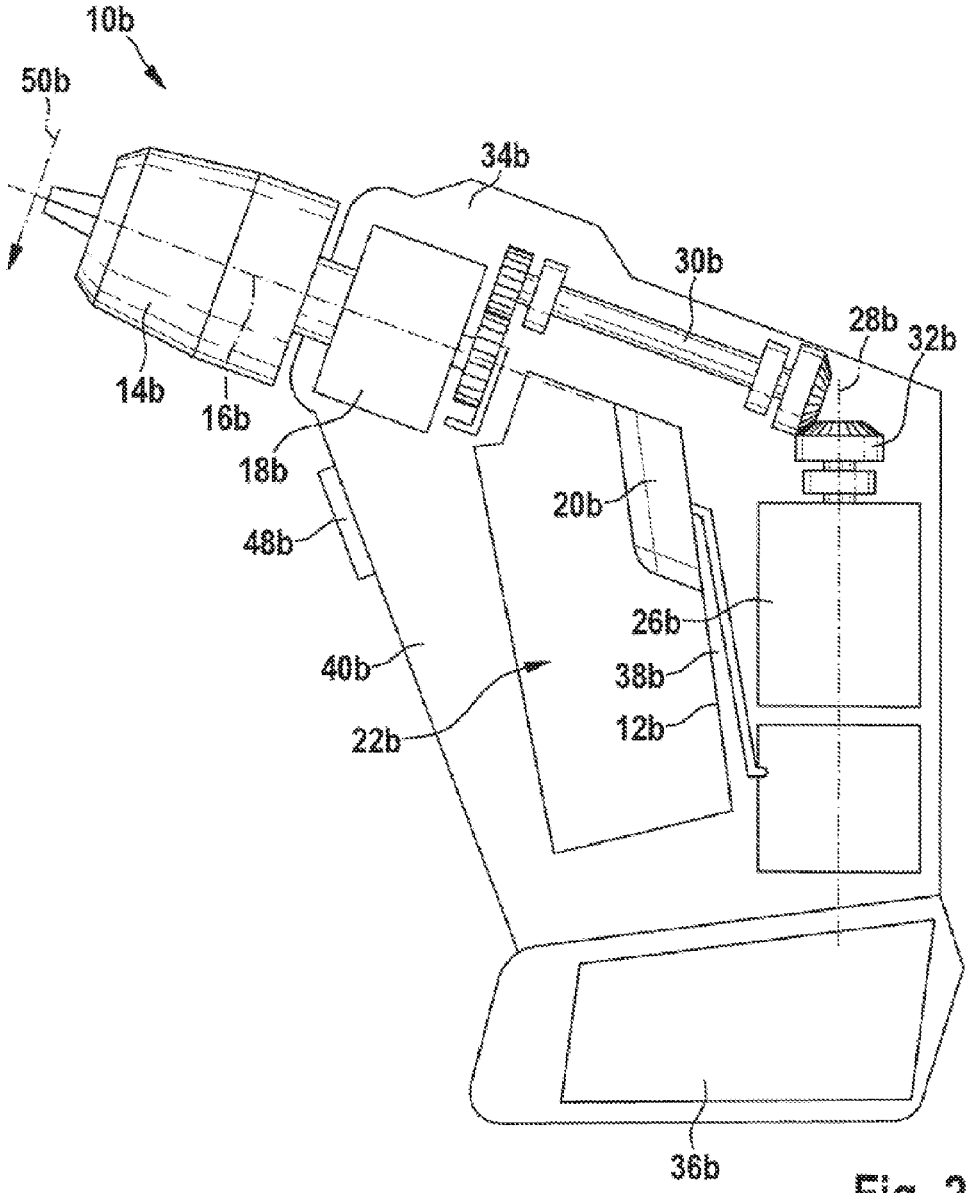
FIG. 2 shows an alternative embodiment of a portable machine tool, having a grip protection for the handle.

The alternative embodiment of a cordless machine tool 10*b* in FIG. 2 is substantially identical to the previous illustrative embodiment and differs from this merely by an additional grip protection element 40*b*, which, starting from the upper housing part 34*b*, in a normal operating state extends facing toward the floor and, in a direction of view through the housing part 34*b* along a center axis 16*b* up to a tool holder unit 14*b*, is disposed behind a handle 38*b* configured as a pistol grip 12*b*. The grip protection element 40*b* is configured to offer additional protection, during guidance of the cordless machine tool 10*b*, for a hand of a user which is clasping the handle 38*b*. A further actuating element 48*b* for actuation of the cordless machine tool 10*b* is disposed on the grip protection element 40*b*.

Figure 3:
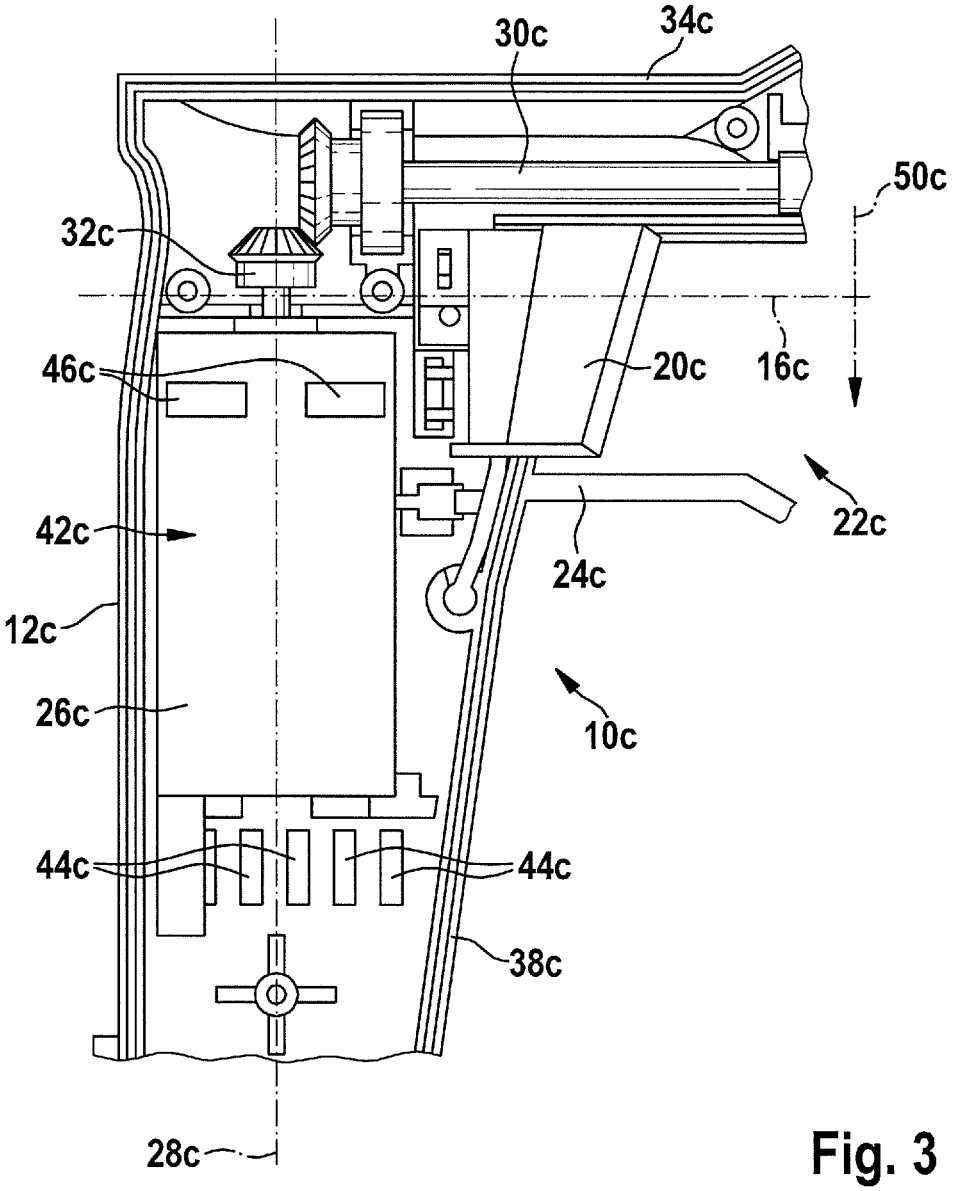
FIG. 3 shows an alternative embodiment of a portable machine tool, having a drive motor, with internal fan, disposed in a handle.
Figure 4:
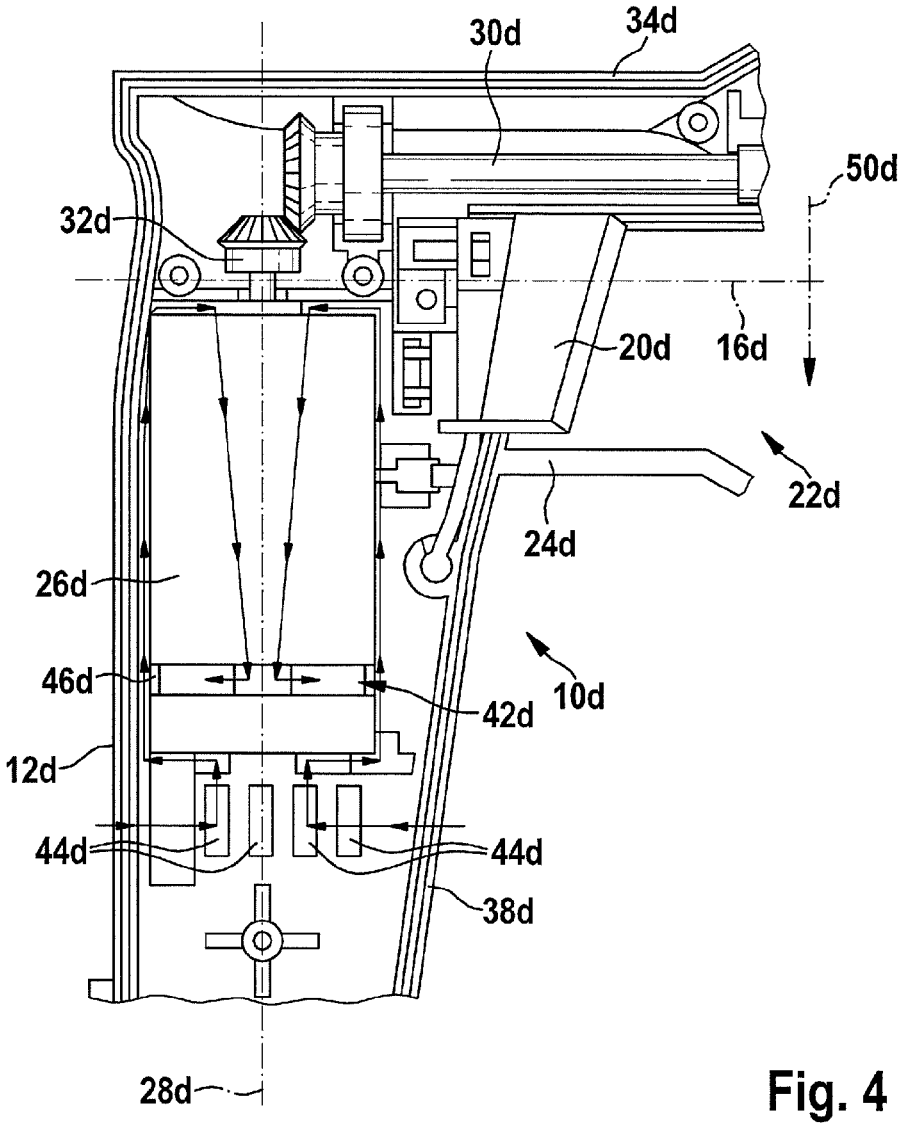
FIG. 4 shows a further alternative embodiment of a portable machine tool, having a drive motor, with internal fan, disposed in a handle.
Figure 5:
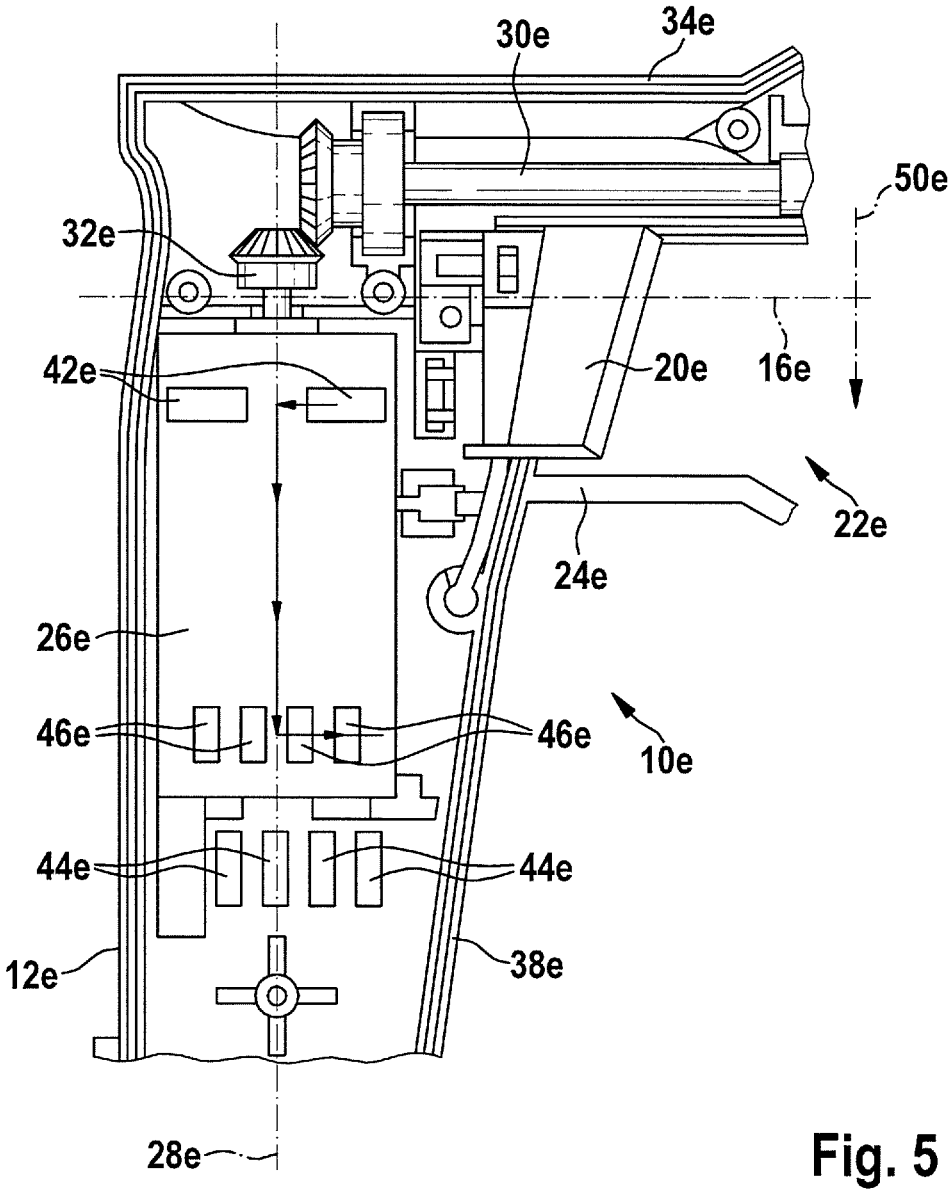
FIG. 5 shows a further alternative embodiment of a portable machine tool, having a drive motor, with internal fan, disposed in a handle.
Figure 6:
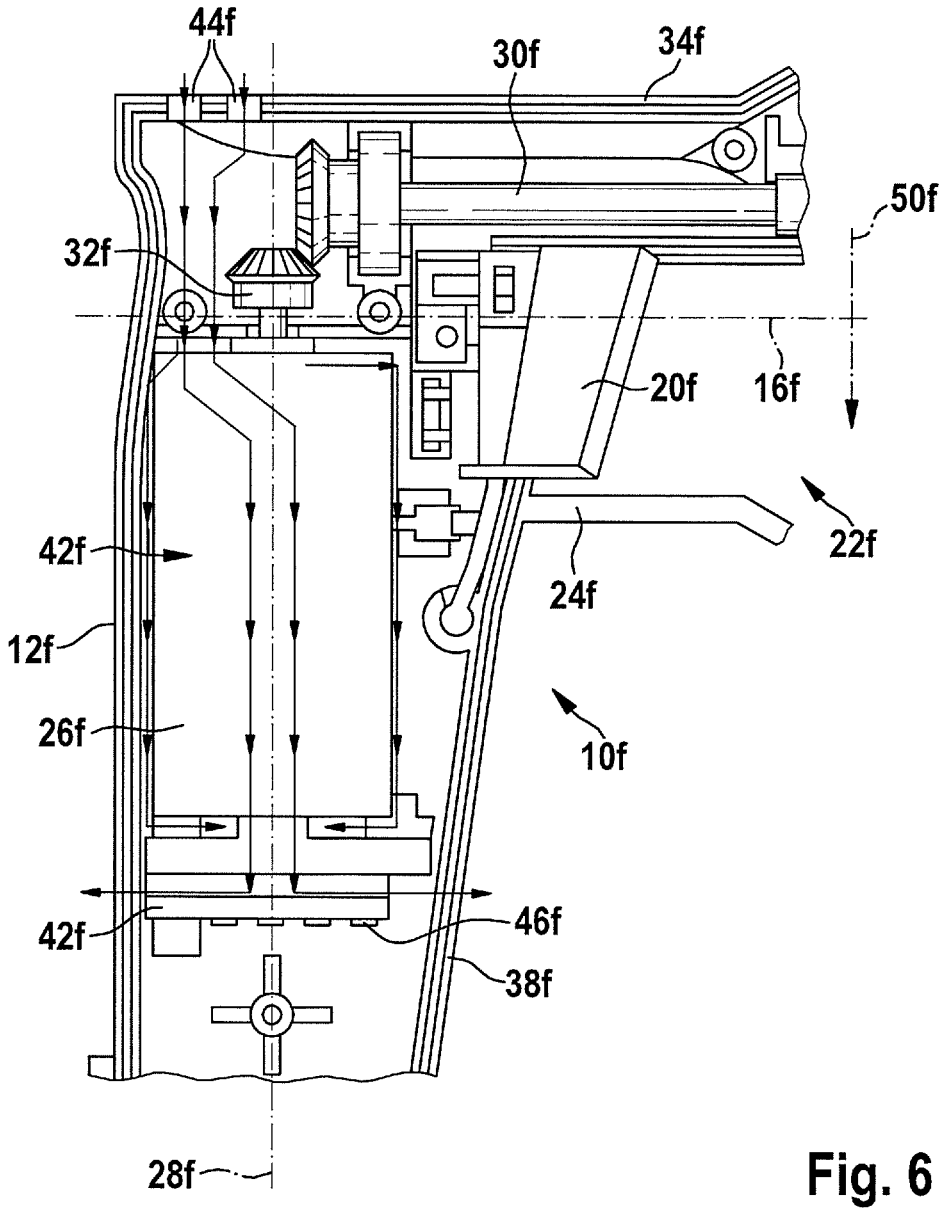
FIG. 6 shows an alternative embodiment of a portable machine tool, having a drive motor, with external fan, disposed in a handle.

FIG. 3 shows a detail of an alternative cordless machine tool 10*c*, which is configured as a cordless screwdriver constructed substantially analogously to the previous illustrative embodiments. A center axis 16*c* of a tool holder unit (not represented in the shown detail) runs through a surrounding area of and, in particular, directly through an actuating element 20*c* disposed in an actuating finger enclosure 22*c*. The cordless machine tool 10*c* comprises a handle 38*c*, which is configured as a pistol grip 12*c* and within which a drive motor 26*c* is disposed, and an upper housing part 34*c*, in which the actuating finger enclosure 22*c* is disposed. The actuating finger enclosure 22*c* is configured such that it is closed by a connecting web 24*c* in the downward direction, i.e. on a side running parallel to the center axis 16*c* and facing toward the handle 38*c*. The drive motor 26*c* has a diameter of 28 mm and a length of 54 mm, which is more than one and a half times as large as the diameter. The drive motor 26*c* is configured as a brushless direct-current motor, i.e. as a direct-current motor having an electronic circuit which replaces a mechanical commutator with brushes for commutation to generate a rotating magnetic field from a direct current, which mechanical commutator is otherwise necessary in direct-current motors. The cordless machine tool 10*c* further comprises a fan unit 42*c*, which is configured to ventilate and cool the drive motor 26*c* and is integrated in the drive motor 26*c*. Via air passage openings 44*c* disposed on the handle 38*c* in a region beneath the drive motor 26*c*, i.e. on a side of the drive motor 26*c* which is facing away from the upper housing part 34*c*, the fan unit 42*c* sucks up air from a space outside the cordless machine tool 10*c* for cooling of the drive motor 26*c*. Heated waste air is blown out through further air passage openings 46*c*, which are disposed radially on an upper region of the drive motor 26*c*. The fan unit 42*c* is thus disposed partially in an upper region of the drive motor 26*c*. In principle, in an alternative embodiment, air can also be sucked up via the further air passage openings 46*c* and blown out via the air passage openings 44*c*. The drive motor 26*c* is cooled from inside by the integrated fan unit 42*c*. An angle gear unit 32*c* connects the drive motor 26*c* to a connecting drive train unit 30*c* and deflects a force flux from a direction of a motor axis 28*c* of the drive motor 26*c* which runs perpendicular to the center axis 16*c* into a direction of the connecting drive train unit 30*c* which runs parallel to the center axis 16*c*. In principle, the motor axis 28*c* can also form an angle other than ninety degrees with the center axis 16*c*.

In a further alternative embodiment (FIG. 4) of a cordless machine tool 10*d*, this is configured substantially analogously to the previous illustrative embodiment with an upper housing part 34*d* and a handle 38*d* configured as a pistol grip 12*d*. In the handle 38*d* is disposed a drive motor 26*d*, which is connected by means of an angle gear unit 32*d* to a connecting drive train unit 30*d* in the upper housing part 34*d*, wherein the angle gear unit 32*d* deflects a force flux from a direction of a motor axis 28*d* which runs perpendicular to a center axis 16*d* into a direction of the connecting drive train unit 30*d* which runs parallel to the center axis 16*d*. In principle, the motor axis 28*d* can also form an angle other than ninety degrees with the center axis 16*d*.

The connecting drive train unit 30*d* bypasses an actuating element 20*d* disposed in an actuating finger enclosure 22*d* in the upper housing part 34*d*. The drive motor 26*d* has a diameter of 28 mm and a length of 54 mm, which is more than one and a half times as large as the diameter. The drive motor 26*d* is configured as a brushless direct-current motor i.e. as a direct-current motor having an electronic circuit which replaces a mechanical commutator with brushes for commutation for generating a rotating magnetic field from a direct current, which mechanical commutator is otherwise necessary in direct-current motors. The cordless machine tool 10*d* further comprises a fan unit 42*d*, which is configured to ventilate and cool the drive motor 26*d* and which is integrated in the drive motor 26*d*. The fan unit 42*d* is arranged in a lower region of the drive motor 26*d* and, via air passage openings 44*d* disposed on the handle 38*d* in a region beneath the drive motor 26*d*, i.e. on a side of the drive motor 26*d* which is facing away from the upper housing part 34*d*, sucks up air from a space outside the cordless machine tool 10*d* for cooling of the drive motor 26*d*. Heated air is blown out via further air passage openings 46*d*, which are disposed radially on the drive motor 26*d* in a lower region. In principle, in an alternative embodiment, air can also be sucked up via the further air passage openings 46*d* and blown out via the air passage openings 44*d*. The air sucked up through the air passage openings 44*d* flows past the outside of the drive motor 26*d* and thus cools it from outside, and is conducted through the fan unit 42*d* from above, i.e. from a side facing toward the upper housing part 34*d*, and through the drive motor 26*d* for internal cooling thereof, before being blown out through the air passage openings 46*d*. The drive motor 26*d* is thus cooled from inside and outside. The air passage openings 44*d*, 46*d* are arranged at a suitable distance to the actuating element 20*d*, so that, if a one-handed guidance of the cordless machine tool 10*d* is intended, they are not covered by a hand of a user.

A further alternative embodiment (FIG. 5) of a cordless machine tool 10*e* is configured substantially analogously to the previous illustrative embodiment. A fan unit 42*e* for ventilating and cooling a drive motor 26*e* disposed in a handle 38*e* configured as a pistol grip 12*e* is integrated in the drive motor 26*e* and disposed in an upper region of the drive motor 26*e*. The fan unit 42*e* has an air passage opening 44*f*, which is disposed above the drive motor 26*f* and, via air passage openings 44*e* disposed on the handle 38*e* in a region beneath the drive motor 26*e*, i.e. on a side of the drive motor 26*e* which is facing away from an upper housing part 34*e*, sucks up air from a space outside a cordless machine tool 10*e* for cooling of the drive motor 26*e*. Heated air is blown out via further air passage openings 46*e*, which are disposed radially on the drive motor 26*e* in a lower region. In principle, in an alternative embodiment, air can also be sucked up via the further air passage openings 46*e* and blown out via the air passage openings 44*e*. The air sucked up through the air passage openings 44*e* flows past the outside of the drive motor 26*e* and thus cools it from outside, and is conducted through the fan unit 42*e* from above, i.e. from a side facing toward the upper housing part 34*e*, and through the drive motor 26*e* for internal cooling thereof, before being blown out through the air passage openings 46*e*. The drive motor 26*e* is thus cooled from inside and outside. The air passage openings 44*e*, 46*e* are arranged at a suitable distance to an actuating element 20*e*, so that, if a one-handed guidance of a cordless machine tool 10*e* is intended, they are not covered by a hand of a user.

In a further alternative embodiment (FIG. 6) of a cordless machine tool 10*f*, a fan unit 42*f* for a drive motor 26*f* disposed in a handle 38*f* configured as a pistol grip 12*f* is disposed outside the drive motor 26*f*. The fan unit 42*f* is disposed beneath the drive motor 26*f*, i.e. is disposed in a region of the handle 38*f* from which the drive motor 26*f* will be seen to lie between the region and the upper housing part 34*f*. Via air passage openings 44*f* disposed on the handle 38*f* in a region beneath the drive motor 26*f*, i.e. on a side of the drive motor 26*f* which is facing away from an upper housing part 34*f*, the fan unit 42*f* sucks up air from a space outside a cordless machine tool 10*f* for cooling of the drive motor 26*f*. Heated air is blown out via further air passage openings 46*f*, which are disposed radially on the drive motor 26*f* in a lower region. In principle, in an alternative embodiment, air can also be sucked up via the further air passage openings 46*f* and blown out via the air passage openings 44*f*. The air sucked up through the air passage openings 44*f* flows past the outside of the drive motor 26*f* and thus cools it from outside, and is conducted through the fan unit 42*f* from above, i.e. from a side facing toward the upper housing part 34*f*, and through the drive motor 26*f* for internal cooling thereof, before being blown out through the air passage openings 46*f*. The drive motor 26*f* is thus cooled from inside and outside. The air passage openings 44*f*, 46*f* are arranged at a suitable distance to an actuating element 20*f*, so that, if a one-handed guidance of a cordless machine tool 10*f* is intended, they are not covered by a hand of a user.

What is claimed is:

1. A portable machine tool, comprising:

at least one drive motor;

a tool holder unit having a center axis;

at least one gearbox unit;

a connecting drive train unit configured to transmit a force from the at least one drive motor to the at least one gearbox unit, the connecting drive train unit including a rod-shaped portion, wherein the at least one gearbox unit is disposed between the connecting drive train unit and the tool holder unit;

at least one angle gear unit connecting the connecting drive train unit to the drive motor; and at least one actuating element, wherein the connecting drive train unit bypasses the at least one actuating element in such a way that the rod-shaped portion of the connecting drive train unit runs parallel to the center axis of the tool holder unit.

2. The portable machine tool according to claim 1, further comprising a pistol grip.

3. The portable machine tool according to claim 1, wherein the at least one connecting drive train unit is configured to run at least substantially above the at least one actuating element such that the at least one connecting drive train unit is disposed on a side of the actuating element facing toward a top side of the portable machine tool and facing away from a handle of the portable machine tool, and at least sixty percent of a longitudinal extend of the at least one connecting drive train unit is disposed in a region above a projection of the actuating element in a direction perpendicular to a height direction of the actuating element.

4. The portable machine tool according to claim 1, wherein the center axis of the tool holder unit runs at least through a surrounding area of the at least one actuating element.

5. The portable machine tool according to claim 4, wherein the tool holder unit is configured so that the center axis runs through the at least one actuating element.

6. The portable machine tool according to claim 4, further comprising:

a handle, wherein the at least one drive motor is at least substantially disposed within the handle such that at least seventy percent of a volume of the at least one drive motor is located within the handle.

7. The portable machine tool according to claim 6, wherein the at least one drive motor is disposed at least partially in a region which, viewed from the tool holder unit, is situated behind the at least one actuating element on a projection of the actuating element that runs parallel to the center axis and extends in a direction facing away from the tool holder unit.

8. The portable machine tool according to claim 1, further comprising:

an actuating finger enclosure, wherein the at least one actuating element is disposed within the actuating finger enclosure.

9. The portable machine tool according to claim 8, wherein the actuating finger enclosure is configured closed on at least four sides.

10. The portable machine tool at least according to claim 8, wherein the actuating finger enclosure has a height extent of at least 2 cm.

11. The portable machine tool according to claim 1, wherein the portable machine tool is a cordless machine tool.

12. The portable machine tool according to claim 1, wherein the at least one connecting drive train unit bypasses the at least one actuating element such that, due to a position of the at least one actuating element on the portable machine tool, an actual path of transmission of the force from the drive motor to the tool holder unit is longer than a hypothetical path of transmission of the force given a hypothetical course of the connecting drive train unit through the actuating element.

13. The portable machine tool according to claim 1, wherein the rod-shaped portion of the connecting drive train unit runs above the at least one actuating element.

14. A portable machine tool, comprising:

a drive motor;

a handle in which the drive motor is at least substantially disposed such that at least seventy percent of a volume of the drive motor is located within the handle;

a tool holder unit having a center axis;

a gearbox unit;

a connecting drive train unit configured to transmit a force from the drive motor to the gearbox unit, the connecting drive train unit including a rod-shaped portion, wherein the gearbox unit is disposed between the connecting drive train unit and the tool holder unit;

an angle gear unit connecting the connecting drive train unit to the drive motor; and an actuating element arranged such that the center axis of the tool holder unit passes through the actuating element, wherein the connecting drive train unit bypasses the actuating element in such a way that the rod-shaped portion of the connecting drive train unit runs parallel to the center axis of the tool holder unit.

* * * * *